US007914262B2

(12) United States Patent
Hanaoka et al.

(10) Patent No.: US 7,914,262 B2
(45) Date of Patent: Mar. 29, 2011

(54) ELECTROHYDRODYNAMIC PUMP (EHD PUMP) WITH ELECTRODE ARRANGEMENT

(75) Inventors: Ryoichi Hanaoka, Kanazawa (JP); Shinzo Takata, Ishikawa-ken (JP); Tadashi Fukami, Kanazawa (JP)

(73) Assignee: Kanazawa Institute of Technology, Ishikawa-Ken (JP)

( * ) Notice: Subject to any disclaimer, the term of this patent is extended or adjusted under 35 U.S.C. 154(b) by 857 days.

(21) Appl. No.: 11/714,702

(22) Filed: Mar. 6, 2007

(65) Prior Publication Data

US 2008/0131293 A1 Jun. 5, 2008

(30) Foreign Application Priority Data

Dec. 1, 2006 (JP) ..... 2006-325678

(51) Int. Cl.
*F04B 37/00* (2006.01)
*H01T 23/00* (2006.01)
*B05B 5/00* (2006.01)

(52) U.S. Cl. ..... 417/48; 361/230; 239/690

(58) Field of Classification Search ..... 417/48, 417/49; 239/3, 690; 60/202, 203.1; 96/61; 310/10; 315/111.91; 204/600, 601, 450, 204/451; 361/230, 231
See application file for complete search history.

(56) References Cited

U.S. PATENT DOCUMENTS 3,081,020 A * 3/1963 Rostas ..... 417/49
3,156,847 A * 11/1964 Schweriner ..... 361/230
3,519,855 A * 7/1970 Gourdine ..... 310/10
4,634,057 A * 1/1987 Coffee et al. ..... 239/690
(Continued)

FOREIGN PATENT DOCUMENTS

JP 2003-284316 3/2003
(Continued)

OTHER PUBLICATIONS

English Abstract of JP2005269809A.*

*Primary Examiner* — Devon C Kramer
*Assistant Examiner* — Nathan Zollinger
(74) *Attorney, Agent, or Firm* — Brinks Hofer Gilson & Lione

(57) ABSTRACT

To improve the configuration of electrodes disposed in the fluid channel of EHD pumps, and to reduce of the fluid channel of EHD pumps, as well as to reduce the cost of producing EHD pumps, and to increase the pumping pressure of EHD pumps. A hollow conical metal electrode open at the top end and the bottom end is used facing a rod-shaped metal electrode, and an electrically insulated fluid outflow channel is formed facing the hollow conical metal electrode, with the hollow conical metal electrode and rod-shaped metal electrode sharing a central axis, so that the two electrodes are disposed coaxially, and the rod-shaped metal electrode is disposed from the inner portion of the hollow conical metal electrode to the inner portion of the fluid outflow channel, and a portion of the rod-shaped metal electrode, positioned at the interface of at least the inner portion of the hollow conical metal electrode and the fluid outflow channel, serves as an exposed metal part, with this exposed metal part being caused to face the inner surface of the hollow conical metal electrode, and when an electric field is applied across the hollow conical metal electrode and the rod-shaped metal electrode, there is introduced a fluid wherein are formed dissociated ions, and high voltage direct current is applied across the hollow conical metal electrode and the rod-shaped metal electrode.

7 Claims, 12 Drawing Sheets

U.S. PATENT DOCUMENTS

| | | | | |
|---|---|---|---|---|
| 5,121,286 | A * | 6/1992 | Collins | 361/231 |
| 5,907,469 | A * | 5/1999 | Kim et al. | 361/225 |
| 7,236,344 | B2 * | 6/2007 | McCullough | 361/231 |
| 7,375,945 | B2 * | 5/2008 | Izumi et al. | 361/231 |
| 2001/0050881 | A1 * | 12/2001 | Depaoli et al. | 366/167.1 |
| 2004/0195403 | A1 * | 10/2004 | Atterbury et al. | 239/690 |
| 2006/0110544 | A1 * | 5/2006 | Kim et al. | 427/458 |
| 2006/0250746 | A1 * | 11/2006 | McCullough | 361/227 |

FOREIGN PATENT DOCUMENTS

| | | | |
|---|---|---|---|
| JP | 2005269809 | A * | 9/2005 |
| JP | 2006-158169 | | 6/2006 |

* cited by examiner

[FIG. 1]
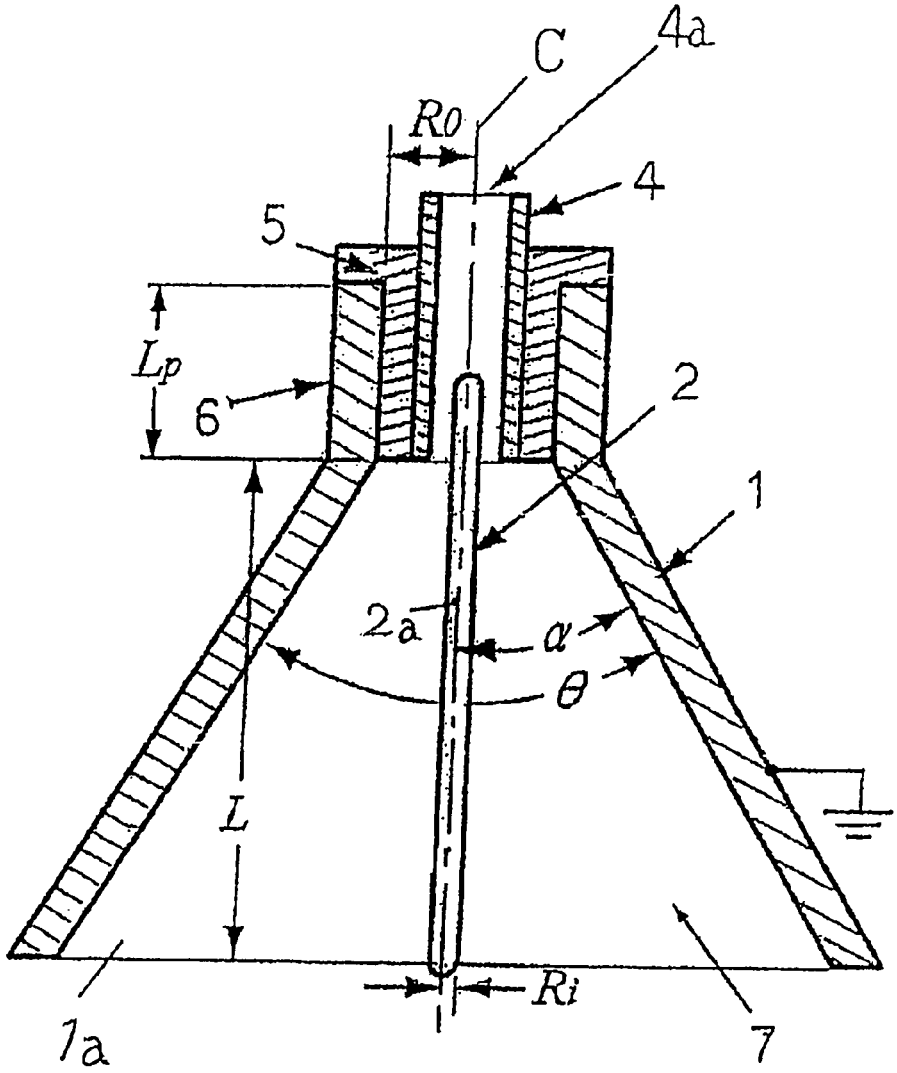

[FIG. 2]
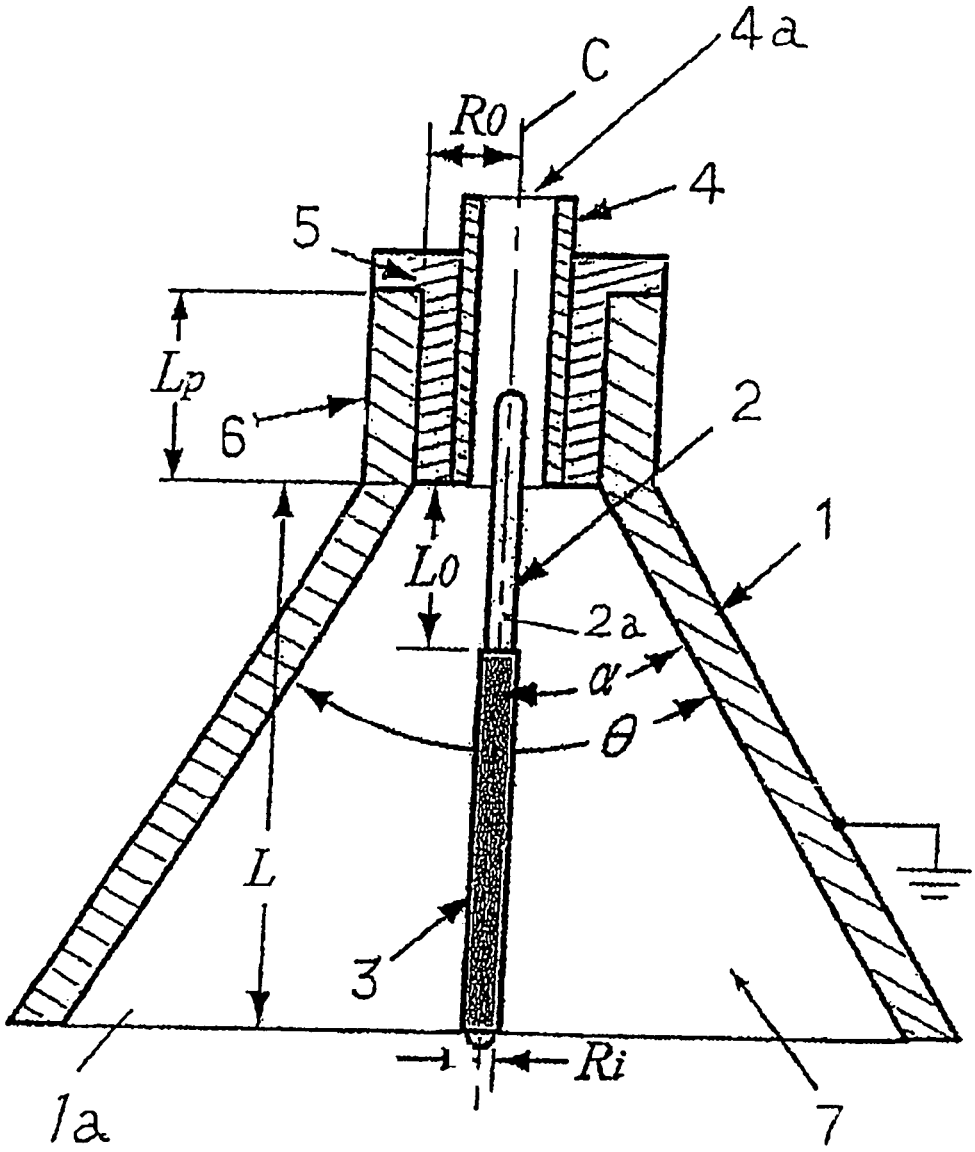

[FIG. 3]
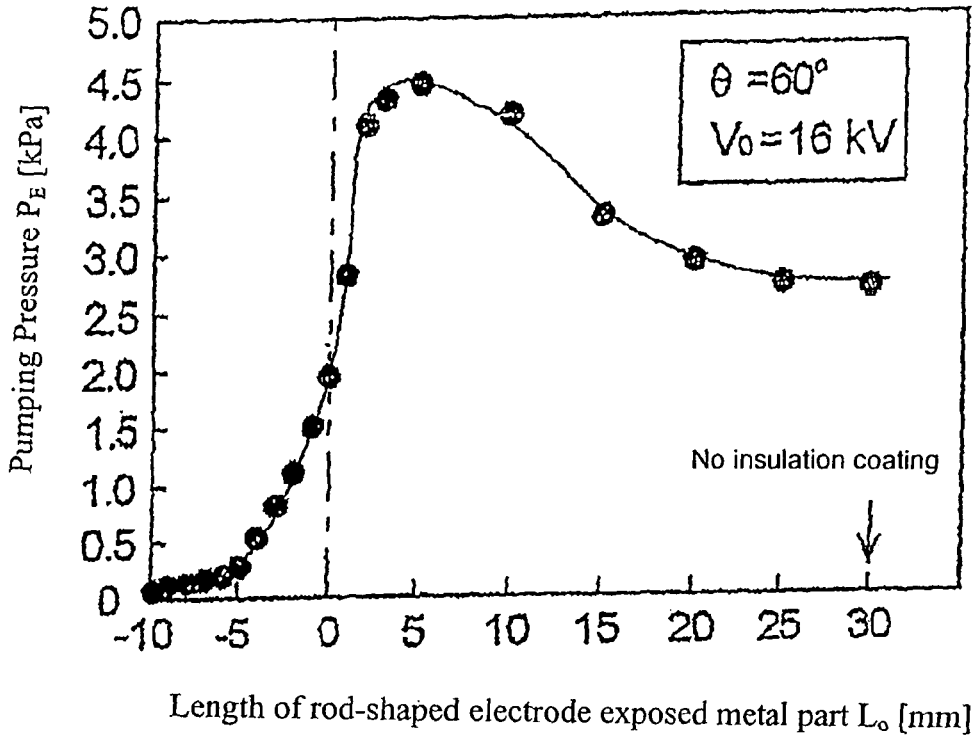

[FIG. 4]
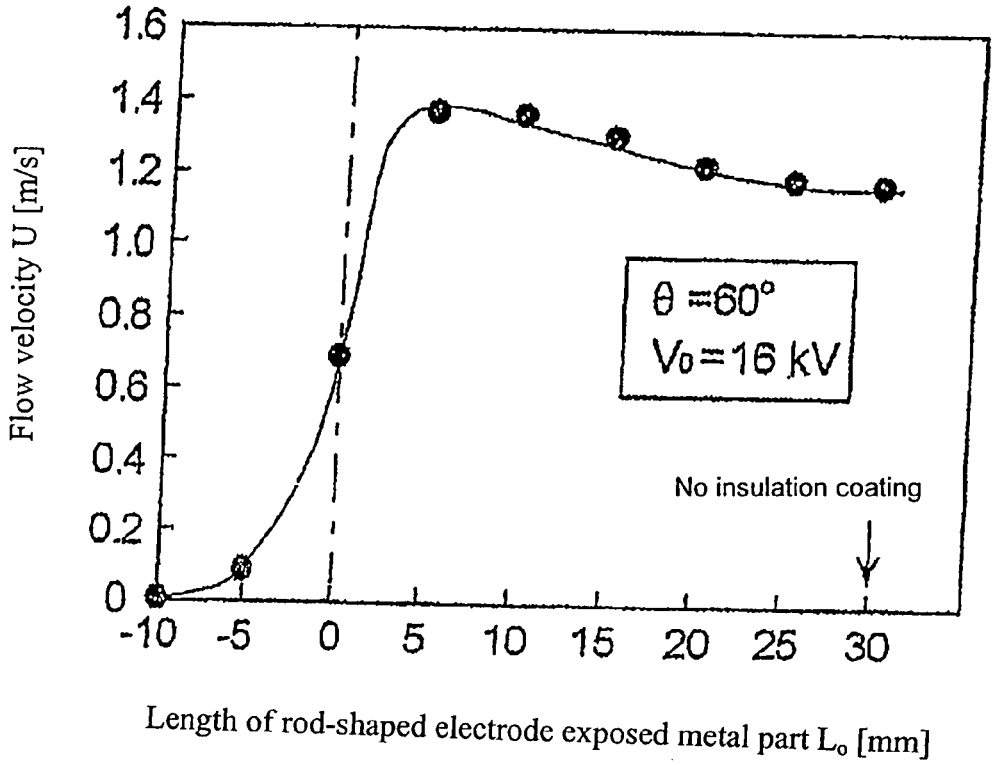

[FIG. 5]
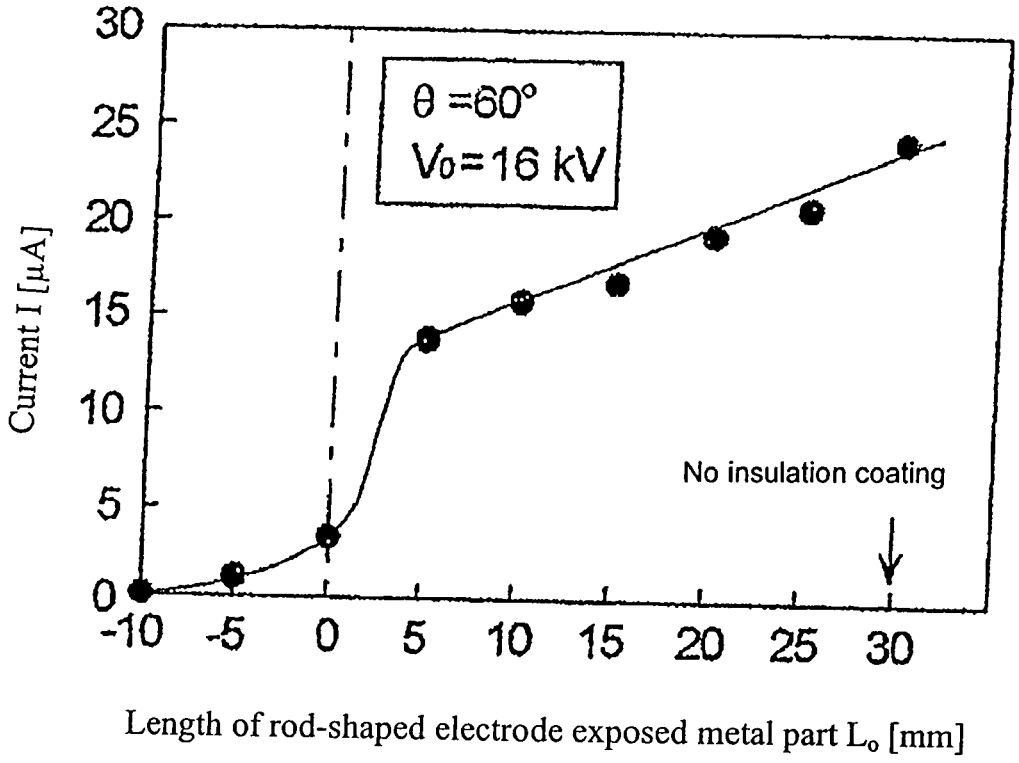

[FIG. 6]
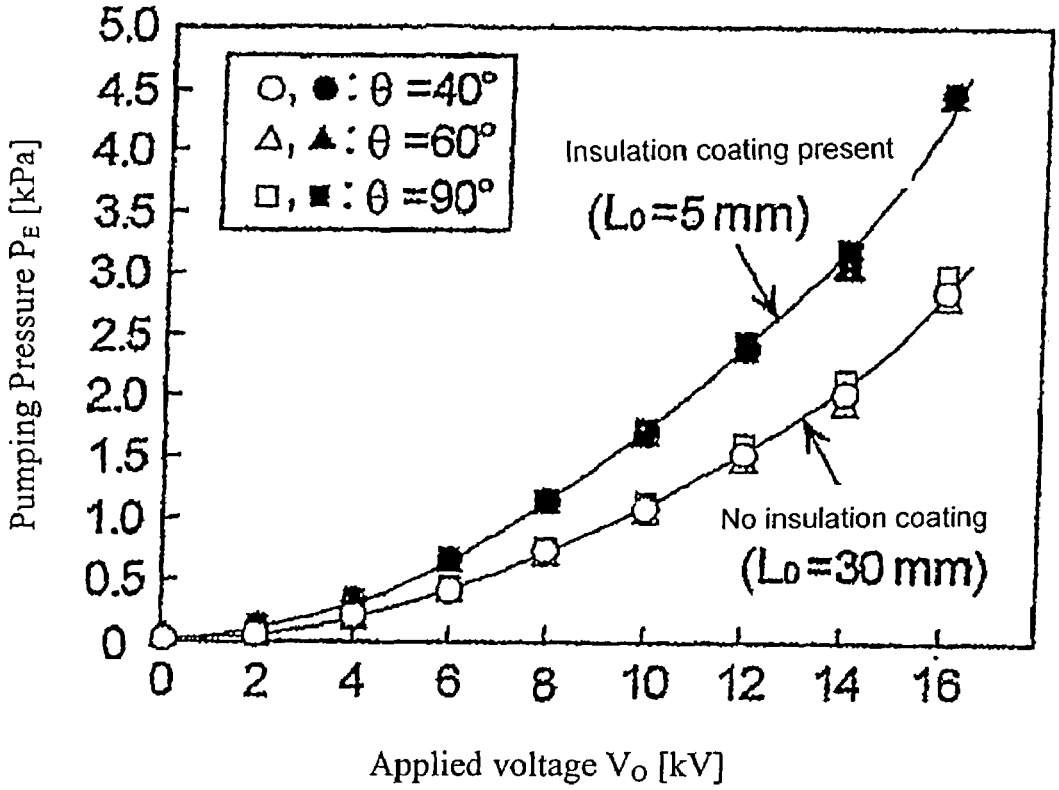

[FIG. 7]
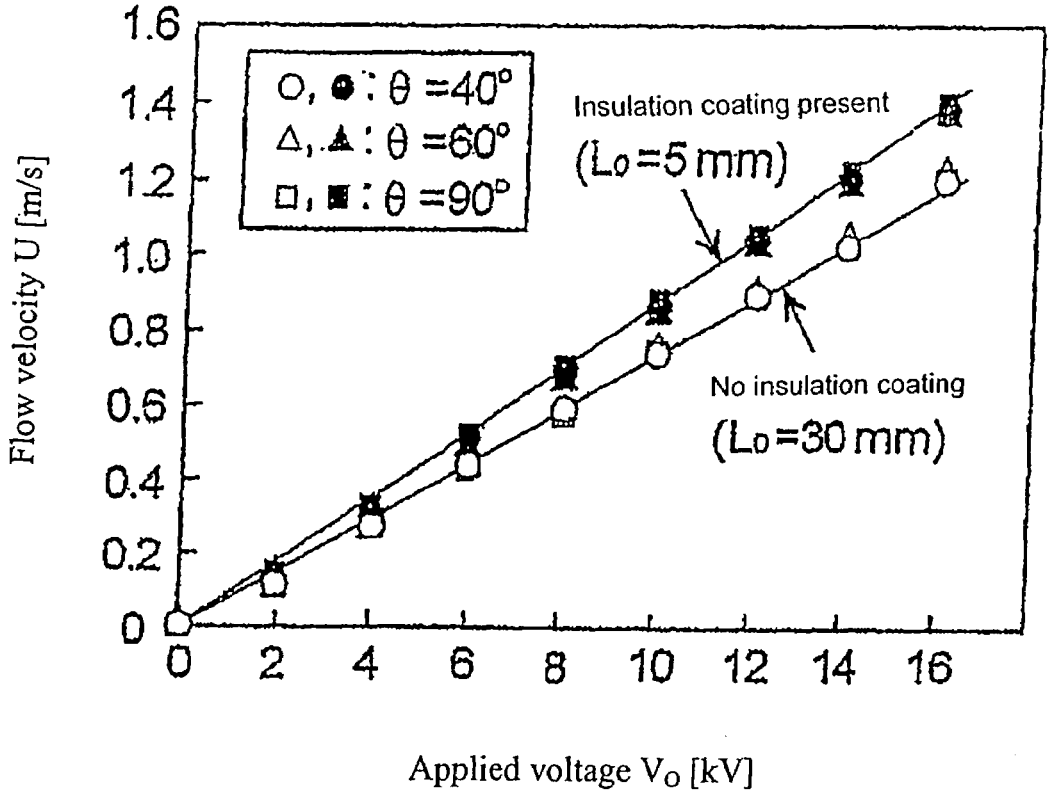

[FIG. 8]
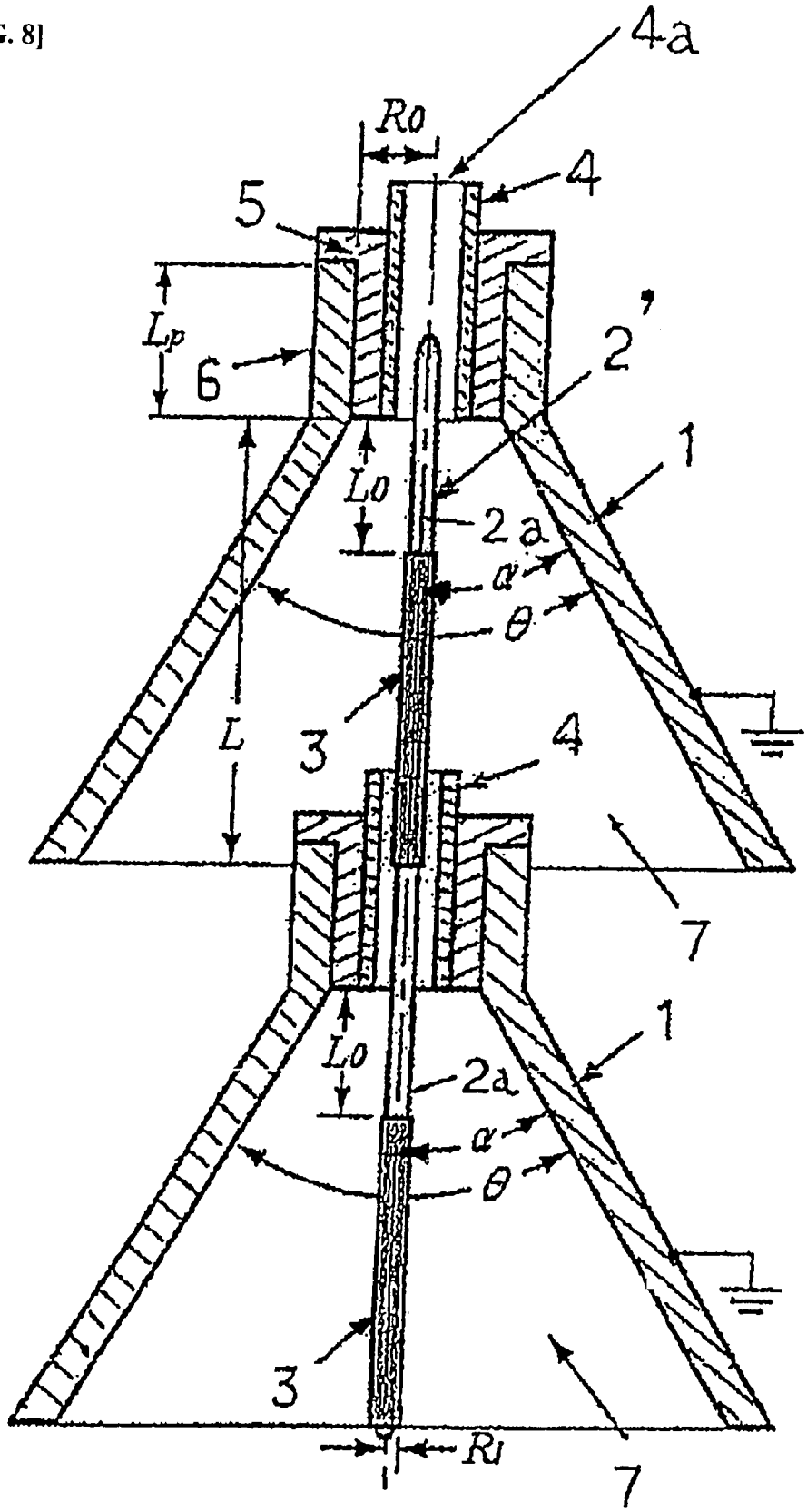

[FIG. 9]
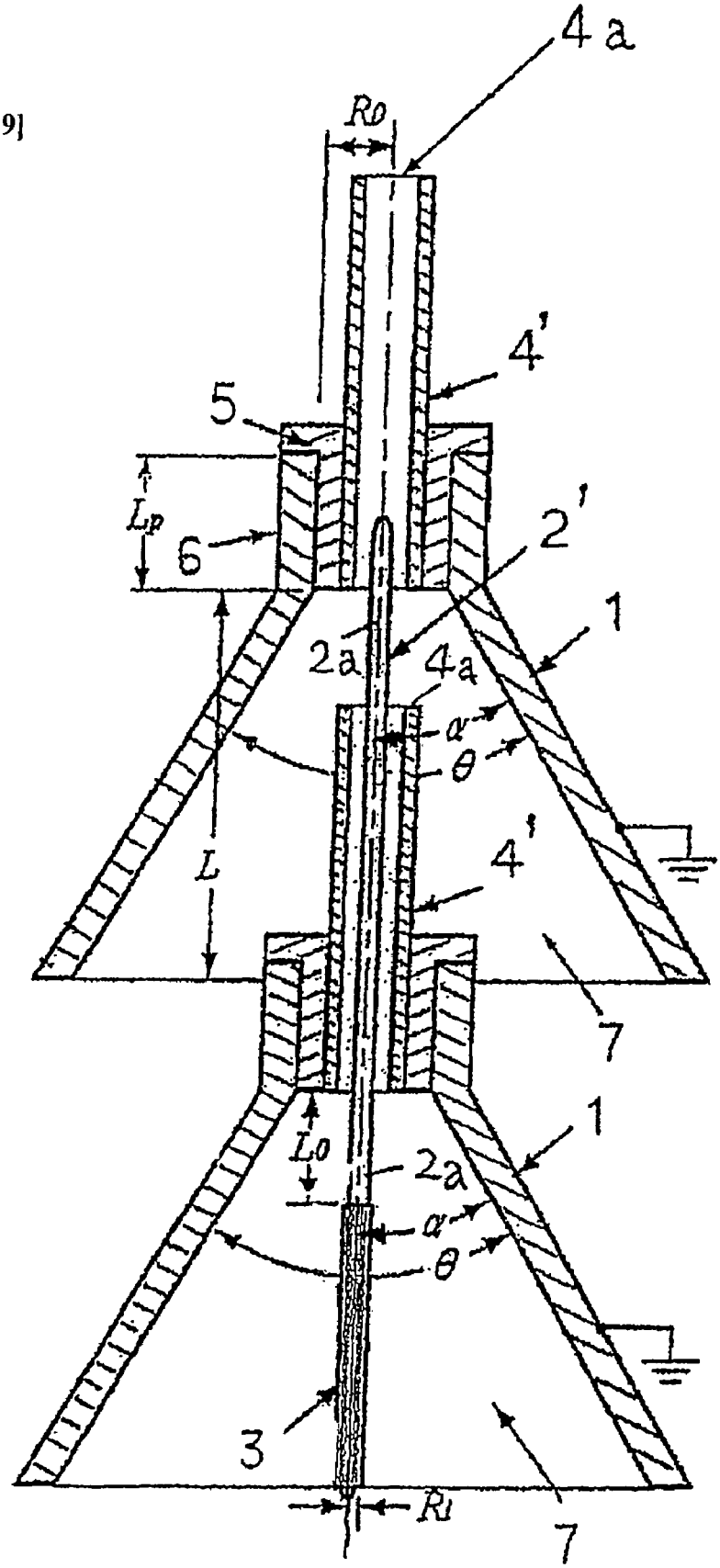

[FIG. 10]
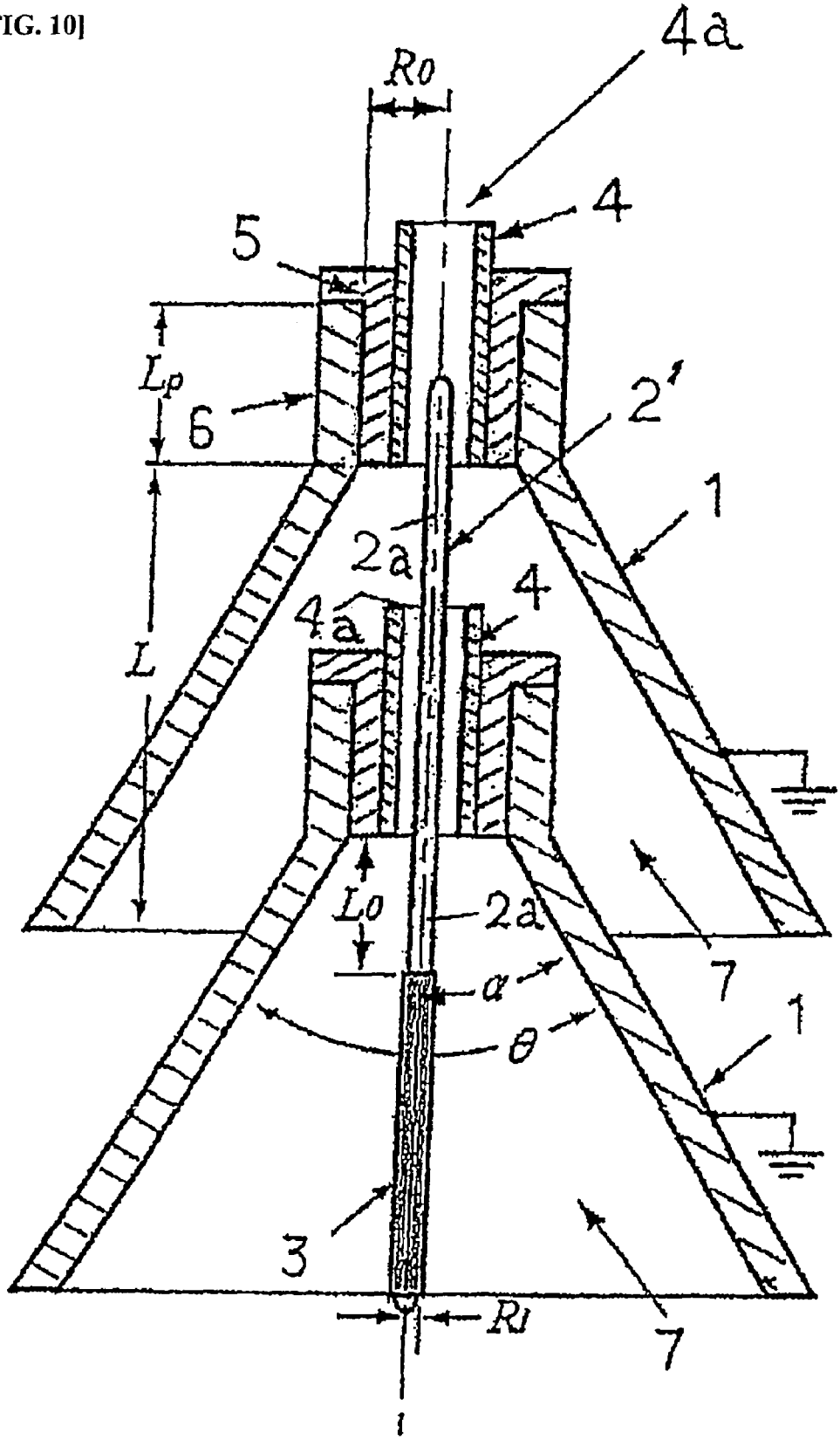

[FIG. 11]
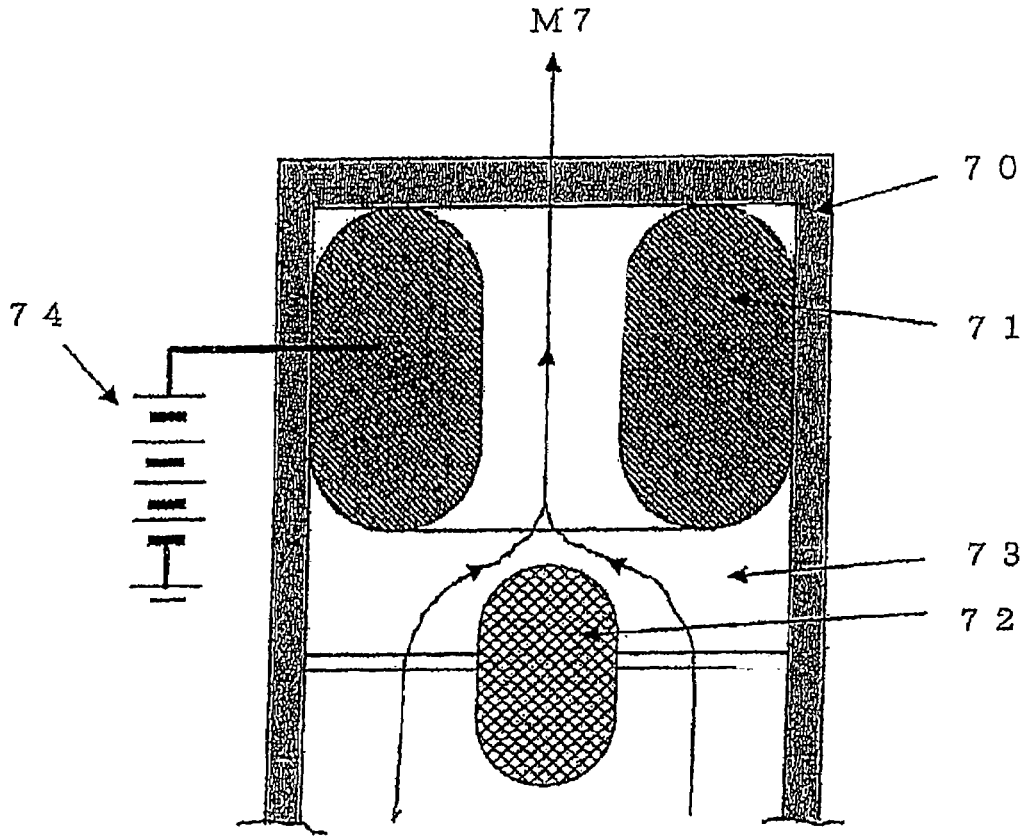

[FIG. 12]
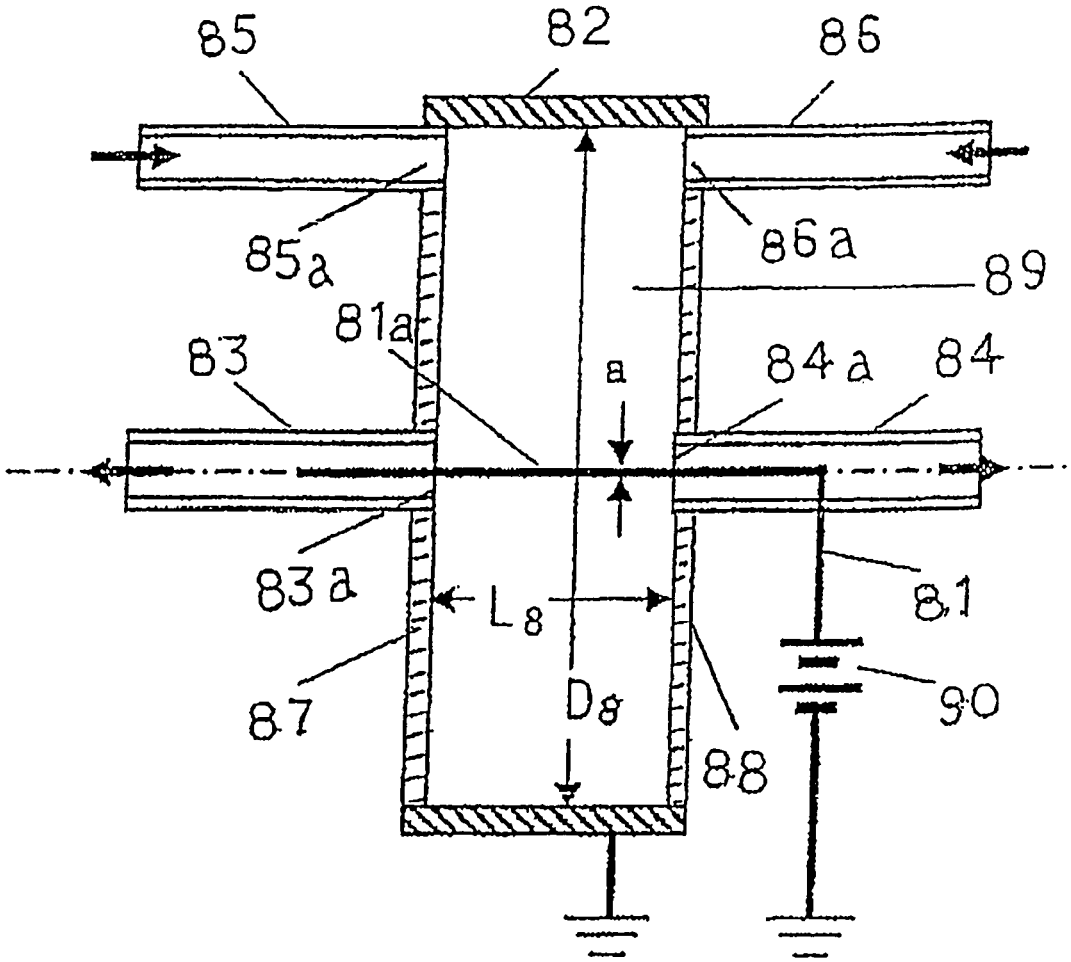

ELECTROHYDRODYNAMIC PUMP (EHD PUMP) WITH ELECTRODE ARRANGEMENT

This application claims priority under 35 U.S.C. §119 to Japanese Patent Application No. JP2006-325678 filed Dec. 1, 2006, the entire content of which is hereby incorporated by reference.

TECHNICAL FIELD

This invention relates to an electrohydrodynamic pump (referred to as an "EHD pump") which propels a fluid in which dissociated ions are formed, by the application of an electric field, within a fluid channel between a pair of electrodes to which high voltage direct current is applied, and in particular, this invention relates to the structure of the electrodes provided within an electrohydrodynamic pump, and the structure of a fluid channel within an electrohydrodynamic pump.

DESCRIPTION OF THE RELATED ART

In mechanical pumps that have been used for many years, which propel a fluid using rotary blades or reciprocating pistons, heat and noise were generated as a result of the friction and vibration accompanying the motion of these blades and pistons, and since maintenance was required to reduce this heat and noise, research and development activities were promoted for devising practical EHD pumps to replace mechanical pumps, and in particular, there was an EHD pump disclosed in Japanese Patent Application Kokai Publication No. 2003-284316 (Patent Reference 1).

FIG. 11 schematically shows the structure of the EHD pump disclosed in Patent Reference 1. In the drawing, within a pump case 70 are disposed an annular electrode 71 and a columnar electrode 72, and a fluid 73 (a fluid with a character such that when an electric field is applied, the positive ions and negative ions are separated in the fluid) in which dissociated ions are formed when an electric field is applied, referred to as "the operating fluid" in this application, is introduced across the annular electrode 71 and the columnar electrode 72, which form a pair, but staggered in the longitudinal direction, with their central axes facing each other, and by applying high voltage direct current from a power source 74 across the annular electrode 71 and the columnar electrode 72, an electric field formed between the annular electrode 71 and the columnar electrode 72 is caused to operate on the operating fluid, thereby propelling the operating fluid. That is to say, dissociated ions are formed in the operating fluid 73 in the vicinity of the annular electrode 71 and the columnar electrode 72, due to the application of high voltage direct current across the annular electrode 71 and the columnar electrode 72, thereby forming a heterocharge layer at the electrode interface, so that the operating fluid 73 is propelled to flow in the manner shown by the arrow M7, due to a Coulombic force generated between the ions within this heterocharge layer and the electrodes. However, in such a prior art EHD pump, there was the drawback of increased channel resistance of the fluid channel formed within the pump, since bulky electrode groups had to be disposed within the pump, with the annular electrode 71 and the columnar electrode 72 staggered in the coaxial longitudinal direction and facing each other. There was also the drawback that the cost of producing the electrode configuration was high, because of a structure in which the annular electrode 71 and the columnar electrode 72 are staggered in the coaxial longitudinal direction and facing each other.

In order to eliminate these drawbacks, an EHD pump was disclosed such as that described in Japanese Patent Application Kokai Publication No. 2006-158169 (Patent Reference 2). FIG. 12 schematically shows the structure of the EHD pump disclosed in Patent Reference 2. That is to say, FIG. 12 shows an internal linear metal electrode 81 with an outer diameter a, an external electrode 82, cylindrical in shape and made from stainless steel (metal), b is the inner diameter of the external electrode 82, and L8 is the length of the inner dimension of the external electrode 82. Furthermore, the metal surface of the internal electrode 81 is exposed within the external electrode 82, and the length of the exposed metal part 81*a* in the external electrode 82 corresponds to the length L8. Also, the internal electrode 81 and the external electrode 82 are disposed coaxially. 83 and 84 are electrically insulated fluid outflow ducts, and 85 and 86 are fluid return flow ducts. The fluid outflow ducts 83 and 84 communicate with the inner part of the external electrode 82 at the central part of the external electrode 82, and the fluid return flow ducts 85 and 86 communicate with the inner part of the external electrode 82 at the peripheral part of the external electrode 82. It should be noted that both ends of the external electrode 82 are sealed respectively by electrically insulated end plates 87 and 88. Furthermore, 89 is a fluid (operating fluid) in which dissociated ions are formed when an electric field is applied, and 90 is a high voltage direct current source. When high voltage direct current is applied across the internal electrode 81 and the external electrode 82, a strong electric field is formed between the exposed metal part 81*a* of the internal electrode 81 and the external electrode 82, and since the internal electrode 81 and the external electrode 82 are coaxially disposed electrodes, an asymmetric electric field is formed, and a particularly strong electric field is formed in the vicinity of the surface of the exposed metal part 81*a* of the internal electrode 81. As a result, when a weakly conductive fluid in which negative ions are readily formed as dissociated ions is used as the operating fluid, and when a positive (+) potential is imparted to the internal electrode 81, and a negative (−) potential is imparted to the external electrode 82, a pushing force (pressure toward the axial center) is generated on the ions in the heterocharge layer in a direction normal to the electrode surface, and this force extends to the entire surface of the exposed metal part 81*a* of the internal electrode 81, but the vectors of this force cancel each other out, and the integral value thereof is zero. However, since this pressure dissipates in the vicinity of the outlet ports 83*a* and 84*a* of the fluid outflow ducts 83 and 84, a pressure differential newly arises in the axial direction toward the outlet ports 83*a* and 84*a*, and this pressure differential becomes a source of pumping pressure on the operating fluid.

As described above, when high voltage direct current is applied across the internal electrode 81 and the external electrode 82 and the strength of the electric field on the surface of the exposed metal part 81*a* of the internal electrode 81 reaches an elevated strength on the order of 50-100 kV/cm, a strong electric field is generated from the cylindrical external electrode 82 toward the exposed metal part 81*a* of the internal electrode 81, and this strong electric field acts on the operating fluid 89, and great pressure acts on the operating fluid 89 in the vicinity of the surface of the exposed metal part 81*a* of the internal electrode 81, so that a pumping function results, with the operating fluid 89 flowing along the axial direction of the exposed metal part 81*a* of the internal electrode 81 and of the fluid outflow ducts 83 and 84, and the operating fluid 89, which is discharged from the fluid outflow ducts 83 and 84 passes through external ducts (not pictured), and flows into fluid return holes 85*a* and 86*a*, respectively, from the fluid return flow ducts 85 and 86, and thus circulated. In accordance with such an electrode configuration, the channel resistance to the operating fluid 89 was greatly reduced, but the region in which pressure in the axial direction of the fluid outflow ducts 83 and 84 that can be effective utilized is in a narrow range on the order of 0.7 mm in the vicinity of the outlet ports 83*a* and 84*a* of the fluid outflow ducts 83 and 84, so it is difficult to greatly increase the pumping pressure by means of this electrode configuration. Moreover, in this electrode configuration, there is a tendency to use larger electrodes, from the standpoint of electrode manufacture, so the cost of producing the electrode configuration becomes high.

[Patent Reference 1] Japanese Patent Application Kokai Publication No. 2003-284316

[Patent Reference 2] Japanese Patent Application Kokai Publication No. 2006-158169

SUMMARY OF THE INVENTION

This invention was devised in view of the drawbacks of the prior art EHD pump as described above, so as to improve the configuration of the electrodes disposed in the fluid channel of an EHD pump, and aims to reduce the channel resistance within an EHD pump, and to reduce manufacturing costs associated with an electrode configuration disposed within a fluid channel in an EHD pump, as well as to raise the pumping pressure of an EHD pump by increasing the region in which pumping pressure is generated in an EHD pump, thereby raising the pumping pressure of an EHD pump.

In order to solve these problems, a major feature of this invention is that it utilizes a hollow conical metal electrode instead of the cylindrical electrode used in the prior art EHD pump. A hollow conical metal electrode open at the top end and the bottom end is used facing a rod-shaped metal electrode, and an electrically insulated fluid outflow channel is formed facing the hollow conical metal electrode, with the hollow conical metal electrode and rod-shaped metal electrode sharing a central axis, so that the two electrodes are disposed coaxially, and the rod-shaped metal electrode is disposed from the inner portion of the hollow conical metal electrode to the inner portion of the fluid outflow channel, and a portion of the rod-shaped metal electrode, positioned at the interface of at least the inner portion of the hollow conical metal electrode and the fluid outflow channel, serves as an exposed metal part, with this exposed metal part being caused to face the inner surface of the hollow conical metal electrode, and when an electric field is applied across the hollow conical metal electrode and the rod-shaped metal electrode, there is introduced a fluid (operating fluid) wherein are formed dissociated ions, and high voltage direct current is applied across the hollow conical metal electrode and the rod-shaped metal electrode.

Furthermore, as an electrode configuration for raising the pumping pressure, a hollow conical metal electrode open at the top end and the bottom end is used facing a rod-shaped metal electrode, and at the open top end of this hollow cylindrical metal electrode is formed an electrically insulated fluid outflow channel facing the hollow conical metal electrode, with the hollow conical metal electrode and rod-shaped metal electrode sharing a central axis, so that the two electrodes are disposed coaxially, and the rod-shaped metal electrode is disposed from the inner portion of the hollow conical metal electrode to the inner portion of the fluid outflow channel, and a portion of the rod-shaped metal electrode, positioned at the interface of the inner portion of the hollow conical metal electrode and the fluid outflow channel, serves as an exposed metal part, and a portion other than the exposed metal part serves as the electrical insulation-coated part, and the exposed metal part of the rod-shaped metal electrode and the electrical insulation-coated part are caused to face the inner surface of the hollow conical metal electrode, as a fluid channel between the hollow conical metal electrode and the rod-shaped metal electrode, so that the fluid in which dissociated ions are formed when an electric field is applied, is introduced into the fluid channel, and high voltage direct current is applied across the hollow conical metal electrode and the rod-shaped metal electrode.

Furthermore, with regard to the exposed metal part of the rod-shaped metal electrode, the length $L_0$ of the exposed metal part of the rod-shaped metal electrode protruding from the lower end of the fluid outflow channel formed at the open top end of the hollow conical metal electrode to the inner part of the hollow conical metal electrode is set at 15 mm or less.

Furthermore, with regard to the fluid outflow channel formed at the open top end of the hollow conical metal electrode, the fluid outflow channel is formed with an electrically insulated fluid outflow duct installed at the open top end of the hollow conical metal electrode.

Moreover, this invention utilizes 2,3-dihydrodecafluoropentane (abbreviated as "HFC 43-10"), which has the property that when an electric field is applied, dissociated ions are formed, as the fluid introduced between the hollow conical metal electrode and the rod-shaped metal electrode.

In addition, in order to increase the pumping capacity, an EHD pump construction as described above is used, that is to say, an EHD pump construction provided with a hollow conical metal electrode and a rod-shaped metal electrode, and at the open top end of this hollow cylindrical metal electrode is formed an electrically insulated fluid outflow channel facing the hollow conical metal electrode, with the hollow conical metal electrode and rod-shaped metal electrode sharing a central axis, so that the two electrodes are disposed coaxially, and the rod-shaped metal electrode is disposed from the inner portion of the hollow conical metal electrode to the inner portion of the fluid outflow channel, and the exposed part of the rod-shaped electrode is caused to face the inner surface of the hollow conical metal electrode, so that the fluid in which dissociated ions are formed when an electric field is applied, is introduced into the fluid channel, between the hollow conical metal electrode and the rod-shaped metal electrode, and high voltage direct current is applied across the hollow conical metal electrode and the rod-shaped metal electrode, and a plurality of such pumps can be used, either concatenated or joined in series.

In accordance with the constitution of the EHD pump of this invention as described above, in addition to the fact that there are no moving parts, since there are no bulky electrodes to create great resistance to fluid flow, there is little loss of fluid energy, vibration and noise due to friction and vibration are suppressed, and pumping pressure can be increased, and since the configuration of the electrodes is very simple, the cost of producing the EHD pump can be reduced.

Also, the pumping pressure of the EHD pump can be increased, due to the fact that the EHD pump of this invention employs an electrode configuration in which a rod-shaped metal electrode is disposed along the central axis of a hollow conical metal electrode, instead of a prior art electrode configuration in which a linear internal electrode was disposed along the central axis of a cylindrical external electrode, and especially due to the fact that this invention employs a hollow conical metal electrode instead of a cylindrical external electrode as often used in the prior art. That is to say, in the case of a prior art electrode configuration described above, wherein a linear internal electrode was disposed along the central axis of a cylindrical external electrode, the linear internal electrode was parallel to the inner wall surface of the cylindrical external electrode, and the distance between the cylindrical external electrode and the linear internal electrode was uniform, on any surface in the central axial longitudinal direction of the linear internal electrode, and the electrical field between the cylindrical external electrode and the linear internal electrode was also uniform in the central axial longitudinal direction. Therefore, due to the fact that a heterocharge layer is formed uniformly across the entire surface of the linear internal electrode, the pressure in the direction of the center of the linear internal electrode which is applied to the operating fluid disposed between the cylindrical external electrode and the linear internal electrode is cancelled out by the entire surface of the linear internal electrode, and since a pressure differential arises in the central axial longitudinal direction, the pumping capacity is greatly reduced. By contrast, in this invention, the electrode configuration disposes a rod-shaped metal electrode along the central axis of a hollow conical metal electrode, and the pressure due to a heterocharge layer that forms on the surface of the rod-shaped metal electrode develops a gradient that decreases in the longitudinal direction toward the larger diameters of the hollow conical metal electrode. Consequently, the pressure differential in the electrode central axial direction is not cancelled out, and the more it is oriented toward the smaller diameters of the hollow conical metal electrode, the more it contributes to a stronger electric field and a greater pumping pressure.

BRIEF DESCRIPTION OF THE DRAWINGS

FIG. 1 shows a vertical sectional view of an electrohydrodynamic pump (EHD pump) illustrating a preferred embodiment of this invention.

FIG. 2 shows a vertical sectional view of an EHD pump illustrating another preferred embodiment of this invention.

FIG. 3 illustrates a characteristic curve showing the relationship between the length $L_0$ of the exposed metal part of the rod-shaped metal electrode and the pumping pressure $P_E$ of this EHD pump.

FIG. 4 illustrates a characteristic curve showing the relationship between the length $L_0$ of the exposed metal part of the rod-shaped metal electrode and the flow velocity U of the fluid jet of this EHD pump.

FIG. 5 shows a characteristic curve showing the relationship between the length $L_0$ of the exposed metal part of the rod-shaped metal electrode and the current I of this EHD pump.

FIG. 6 shows a characteristic curve showing the relationship between the voltage $V_0$ applied across the electrodes and the pumping pressure $P_E$ of this EHD pump.

FIG. 7 illustrates a characteristic curve showing the relationship between the voltage $V_0$ applied across the electrodes and the flow velocity U of the fluid jet of this EHD pump.

FIG. 8 shows a structural sectional view of an example where EHD pump structures of this invention are concatenated.

FIG. 9 shows a structural sectional view of another example where EHD pump structures of this invention are concatenated.

FIG. 10 shows a structural sectional view of yet another example where EHD pump structures of this invention are concatenated.

FIG. 11 shows a sectional view of one type of EHD pump of the prior art.

FIG. 12 shows a sectional view of another type of EHD pump of the prior art.

DETAILED DESCRIPTION OF THE PREFERRED EMBODIMENTS

In a preferred embodiment of this invention, a hollow conical metal electrode open at the top end and at the bottom end and a rod-shaped metal electrode are provided, and at the open top end of this hollow cylindrical metal electrode is installed an electrically insulated fluid outflow duct forming an electrically insulated fluid outflow channel facing the hollow conical metal electrode, with the hollow conical metal electrode and rod-shaped metal electrode sharing a central axis, so that the two electrodes are disposed coaxially, and the rod -shaped metal electrode is disposed from the inner portion of the hollow conical metal electrode to the inner portion of the fluid outflow duct, and a portion of the rod-shaped metal electrode, positioned at the interface of the inner portion of the hollow conical metal electrode and the fluid outflow channel, serves as an exposed metal part, and a portion of the rod-shaped metal electrode other than the exposed metal part serves as an electrical insulation-coated part, and the exposed metal part of the rod-shaped metal electrode and the electrical insulation-coated part are caused to face the inner surface of the hollow conical metal electrode, and the length $L_0$ of the exposed metal part of the rod-shaped metal electrode protruding from the lower end of the fluid outflow channel formed at the open top end of the hollow conical metal electrode to the inner part of the hollow conical metal electrode is set at 15 mm or less, and 2,3-dihydrodecafluoropentane (HFC 43-10), which serves as the fluid in which dissociated ions are formed when an electric field is applied, is introduced into the fluid channel between the hollow conical metal electrode and the rod-shaped metal electrode, and high voltage direct current is applied across the hollow conical metal electrode and the rod-shaped metal electrode, resulting in an electrohydrodynamic pump. Several preferred embodiments of this invention are described below.

Preferred Embodiment 1

FIG. 1 is a vertical sectional view of an EHD pump illustrating a basic working example of this invention. FIG. 1 shows a hollow conical metal electrode 1 formed from aluminum. At the top end of the hollow conical metal electrode 1 is formed a cylindrical neck 6, the top end part of which is open. Furthermore, the bottom end part 1*a* of the hollow conical metal electrode 1 is also open. Rod-shaped metal electrode 2 is stainless steel, the entire metal surface of which is exposed along the entire length thereof, forming an exposed metal part 2*a*. A fluid outflow duct 4 is installed in the neck 6 of the hollow conical metal electrode 1 through a plastic electrical insulation tube 5. In the preferred embodiment of FIG. 1, the fluid outflow duct 4 is formed from a glass tube with an outer diameter of 6 mm and an inner diameter of 4 mm, and forms a part of the fluid outflow channel, communicating with the inner part of the hollow conical metal electrode 1. Fluid discharge opening 4*a* is at the upper end of the fluid outflow duct 4. The rod-shaped metal electrode 2 is in the inner part of the hollow conical metal electrode 1, and the hollow conical metal electrode 1 and the rod-shaped metal electrode 2 form a pair of electrodes disposed coaxially, sharing a common central axis C. Moreover, the upper end of the rod-shaped metal electrode 2 extends into the inner part of the fluid outflow duct 4, and the exposed metal part 2*a* (metal surface) of the rod-shaped metal electrode 2 faces the inner surface of the hollow conical metal electrode 1.

It should be noted that Ro is the radius of the inner diameter of the neck 6 of the hollow conical metal electrode, Ri is the radius of the outer diameter of the rod-shaped metal electrode 2, and Lp is the length of the neck 6. Furthermore, L is the length along the central axis C from the lower end of the neck 6 of the hollow conical metal electrode 1 to the lower end of the hollow conical metal electrode 1. Moreover, a is the angle of opening of the conical slope of the hollow conical metal electrode 1 with respect to the central axis C, and θ is the angle of opening of the conical slope of the hollow conical metal electrode 1. In this preferred embodiment, Ro=5 mm, Ri=0.75 mm, Lp=10 mm, and L=30 mm.

Fluid channel 7 is between the hollow conical metal electrode 1 and the rod-shaped metal electrode 2, and when an electric field is applied, a fluid (EHD pump operating fluid—abbreviated as "operating fluid") in which dissociated ions are formed is introduced into the fluid channel 7, and this operating fluid flows in the fluid channel 7 due to the pumping pressure. That is to say, when the hollow conical metal electrode 1 is grounded, and high voltage direct current is applied across the hollow conical metal electrode 1 and the rod-shaped metal electrode 2, the operating fluid that flows into the fluid channel 7 from the opening of the lower end 1*a* of the hollow conical metal electrode 1 undergoes pumping pressure in response to the electric field generated between the hollow conical metal electrode 1 and the rod-shaped metal electrode 2, and flows within the fluid channel 7 toward the open top end of the hollow conical metal electrode 1, and is discharged from the fluid outflow duct 4 as a fluid jet, thereby achieving a pumping function.

In this preferred embodiment, 2,3-dihydrodecafluoropentane (HFC 43-10) is used as the fluid in which dissociated ions are formed when an electric field is applied, and when high voltage direct current is applied across the hollow conical metal electrode 1 and the rod -shaped metal electrode 2, an electric field of 1 kV/cm or greater and 100 kV/cm or less is produced in the vicinity of the surface of the rod-shaped metal electrode 2, resulting in an electrode configuration that produces a variety of experimental results. It should be noted that in the case of an electrode configuration where an electric field of 100 kV/cm or greater is produced, it shifts to an ion drag pumping mechanism, and the direction of flow of the fluid is the inverse of that of a pure conduction pumping mechanism, and the flow reaches a higher level of intensity, but since the operating fluid degrades significantly, this is considered to be disadvantageous. Furthermore, the fluid in which dissociated ions are formed when an electric field is applied is not limited to the aforementioned HFC 43-10. A variety of cryogenic liquids such as 2,2-dichloro-1,1,1-trifluoroethane (abbreviated as "HCFC 123"), and diethylglycol monobutylether acetate (abbreviated as "BCRA"), and di-n-butyl dodecanedioate (abbreviated as "DBDN"), and fluorine-modified silicone oil, and the like can be used, but at this stage, 2,3-dihydrodecafluoropentane (HFC 43-10) is considered advantageous from the standpoint of its global warming coefficient and its ozone depletion coefficient.

Preferred Embodiment 2

FIG. 2 illustrates another preferred embodiment of an EHD pump of this invention. In order to enhance pump characteristics, further improvements were made, using the EHD pump of FIG. 1 as a basis. The construction of the EHD pump of FIG. 2 is identical to that described in FIG. 1, except that the rod-shaped metal electrode 2 is removed. Also, the Reference Symbols (numerals and letters) given in FIG. 2 have the same meaning as in FIG. 1, except for the Reference Symbols "3" and "$L_0$".

That is to say, in the EHD pump shown in FIG. 2, a hollow conical metal electrode 1 open at the top end and at the bottom end 1*a* and a rod-shaped metal electrode are provided, and at the open top end of this hollow cylindrical metal electrode 1 is installed an electrically insulated fluid outflow duct 4 (fluid outflow channel) facing the hollow conical metal electrode 1, with the hollow conical metal electrode 1 and rod-shaped metal electrode 2 sharing a central axis C, so that the two electrodes 1, 2 are disposed coaxially, and the rod -shaped metal electrode 2 is disposed from the inner portion of the hollow conical metal electrode 1 to the inner portion of the fluid outflow duct 4, and a portion of the rod-shaped metal electrode 2, positioned at the interface of the inner portion of the hollow conical metal electrode 1 and the fluid outflow channel 4, serves as the exposed metal part 2*a*, and a portion of the rod-shaped metal electrode 2 other than the exposed metal part 2*a* serves as an electrical insulation-coated part 3, and the exposed metal part 2*a* of the rod-shaped metal electrode 2 and the electrical insulation-coated part 3 are caused to face the inner surface of the hollow conical metal electrode 1, and with the fluid channel 7 between the hollow conical metal electrode 1 and the rod-shaped metal electrode 2, so that the fluid in which dissociated ions are formed when an electric field is applied, is introduced into the fluid channel 7, and high voltage direct current is applied across the hollow conical metal electrode 1 and the rod -shaped metal electrode 2. It should be noted that FIG. 2 shows a fluid discharge 4*a* opening at the upper end of the fluid outflow duct 4, an electrical insulation tube 5, the neck of the hollow conical metal electrode 6, a fluid channel 7 between the hollow conical metal electrode 1 and the rod-shaped metal electrode 2, C is the central axis of the hollow conical metal electrode 1 and the rod-shaped metal electrode 2, L is the length along the central axis C from the lower end of the neck of the hollow conical metal electrode up to the lower end of the hollow conical metal electrode, Lp is the length of the neck 6 of the hollow conical metal electrode, Ro is the radius of the inner diameter of the neck of the hollow conical metal electrode, Ri is the radius of the outer diameter of the rod-shaped metal electrode 2, a is the angle of opening of the conical slope of the hollow conical metal electrode 1 with respect to the central axis C, and θ is the angle of opening of the conical slope of the hollow conical metal electrode 1.

The special feature of the EHD pump shown in FIG. 2 is the structure of the rod-shaped metal electrode 2. That is to say, the rod-shaped metal electrode 2 of the EHD pump shown in FIG. 1 has a structure such that the entire metal surface across its entire length is exposed to the hollow conical metal electrode 1, and there is no part that is treated with electrical insulation on the surface of the rod-shaped metal electrode 2. By contrast, the preferred embodiment illustrated in FIG. 2 differs in that one portion of the rod-shaped metal electrode 2 serves as an exposed metal part 2*a*, while another portion serves as the electrical insulation-coated part 3, and this point is the special feature of the preferred embodiment illustrated in FIG. 2. On the basis of this difference, the properties of the EHD pump are changed. It should be noted that $L_0$ is the length of the exposed metal part 2*a* from the electrical insulation-coated part 3 up to the fluid outflow duct (fluid outflow channel) 4.

Next, FIG. 3 to FIG. 7 show the pumping characteristics based on the results of various experiments on the EHD pump of this invention. The graphs show changes in characteristics such as pumping pressure $P_E$, fluid flow velocity U, and electrical current I, when changes occur in the length $L_0$ of the exposed metal part of the rod-shaped metal electrode, voltage $V_0$ applied across the hollow conical metal electrode and the rod-shaped metal electrode, or the angle of opening θ of the conical slope of the hollow conical metal electrode. It should be noted that in FIGS. 3, 4, 5, 6, and 7, $L_0$ is the length of the exposed metal part 2*a* of the rod-shaped electrode 2 (the length from the tip of the insulation-coated part 3 of the rod-shaped metal electrode up to the lower end of fluid outflow duct 4, 4'), and $L_0$=−10 mm means that the rod-shaped metal electorde 2 is electrical insulation-coated across its entire length, and $L_0$=30 mm means that the rod-shaped metal electrode 2 has exposed metal across its entire length. As shown in FIG. 3, when the voltage $V_0$=+16 kV is applied to the rod-shaped metal electrode 2, the angle of opening of the slope of the hollow conical metal electrode is θ=60° , and $L_0$=5 mm, the pumping pressure $P_E$ is 4.5 kPa, which is the maximum value. Furthermore, when measurements are taken under the same conditions, with the flow velocity U of a fluid jet expelled from the fluid discharge opening 4*a* of the fluid outflow duct 4 has the maximum value of 1.4 m/sec when $L_0$=5 mm, as shown in FIG. 4. However, when the entire rod-shaped metal electrode is the exposed metal part 2*a*, the pumping pressure $P_E$ and the flow velocity U both tend to decrease, but the pumping pressure $P_E$ decreased no further than 30% and the flow velocity U decreased no further than 20%. When further measurements were taken under the same conditions, changes in the current I flowing between the electrodes are as shown in FIG. 5. When $L_0$=5 mm, the current I reached about 14 μA, and the power consumption at that time is estimated at 220 mW. Furthermore, as the length of the exposed metal part of the rod-shaped metal electrode increased, the current gradually increased.

Regarding the angle of opening θ of the hollow conical metal electrode 1 used in preferred embodiments 1 and 2, FIGS. 6 and 7 show the results when the pumping characteristics are measured when θ=40°, θ=60°, and θ=90°. In FIG. 6, the dependence of pumping pressure $P_E$ on the applied voltage $V_0$ is illustrated by the presence or absence of the electrical insulation-coated part 3 in the rod-shaped metal electrode 2. FIG. 6 shows that when $L_0$=5 mm (the electrical insulation-coated part 3 is present) and when $L_0$=30 mm (the electrical insulation-coated part 3 is not present), the pumping characteristics show the same tendencies, but when the applied voltage is $V_0$=16 kV and electrical insulation -coated part 3 is not present, the maximum pumping pressure $P_E$ is about 37% lower than when $L_0$=5 mm. On the other hand, there was found to be almost no dependence on the angle of opening θ of the conical slope of the hollow conical metal electrode 1. When the dependence of fluid jet flow velocity U on the applied voltage $V_0$ was investigated under the same measuring conditions, the relationship between the flow velocity U and the applied voltage $V_0$ showed the same tendencies as in FIG. 6, except for linear relationship shown in FIG. 7, and there was found to be almost no dependence on the angle of opening θ. It should be noted that when the applied voltage $V_0$=16 kV and when $L_0$=5 mm (the electrical insulation-coated part 3 is present), the flow velocity reached 1.4 m/sec.

Preferred Embodiment 3

In yet another preferred embodiment, FIG. 8 describes the results when two pump structures are concatenated, having the EHD pump structure as illustrated in FIGS. 1 and 2. The external dimensions per unit EHD pump structure were basically identical to those of preferred embodiment 1. However, as shown in FIG. 8, the length of the rod-shaped metal electrode 2' was set at 75 mm, which is longer, and the rod-shaped metal electrode 2' was disposed to hang across and pass through the two pump structures. Furthermore, the operating fluid was HFC 43-10 as above. When high voltage direct current of +16 kV was applied to the rod-shaped metal electrode 2', and a fluid jet expelled from the first stage of the fluid outflow channel 4 was supplied to the second stage (upper part of the drawing) of the EHD pump structure, the pumping pressure $P_E$ in the second level fluid outflow channel 4 increases, and the maximum pumping pressure was about 5 kPa. However, the increase in this pumping pressure $P_E$ was less than the predicted double pressure.

Preferred Embodiment 4

Accordingly, a longer fluid outflow duct 4' was installed, as shown in FIG. 9, so as to reduce the resistance of the fluid channel, even if by a little.

Preferred Embodiment 5

Since there was found to be waste in overall combined pump structure of preferred embodiments 3 and 4 above, the distance between the two pumps was further reduced, thereby succeeding in making the configuration much more compact, as shown in FIG. 10. As a result, a maximum pumping pressure of about 8 kPa was obtained.

Preferred Embodiment 6

In yet another preferred embodiment, the results were observed when two EHD pumping structures were joined in series. The external dimensions per unit EHD pump structure were basically identical to preferred embodiment 1, and the EHD pump structures were immersed in an operating fluid tank, and the fluid discharged from two fluid outflow ducts flowed together through a Y-shaped joint, and returned back to the operating fluid tank, and when the pumping pressure was measured, the maximum pumping pressure was 3.5 kPa. The flow rate per unit EHD pump structure was increased from 1 L/min to 1.95 L/min, which is about double, showing load characteristics tending to be similar to ordinary electromagnetic pumps.

The above preferred embodiments show that the EHD pump of this invention generates no noise from friction and vibration, and produces high pumping pressure, due to the fact that there are no electrode groups to cause significant channel interference in the direction of fluid flow, in addition to the fact that there are no moving parts, and since the electrode configuration is very simple, the cost of manufacturing the EHD pump can be kept low. Consequently, the EHD pump of this invention can be employed in a wide array of uses, as an alternative to the mechanical pumps used in the past. Furthermore, since, in principle, it does not use electromagnetic conduction as in the past, no electrical noise is generated, thereby making it possible to expect that the EHD pump of this invention would be useful as a cleaning unit for precision circuitry components and medical equipment, which is disturbed by electrical noise.

What is claimed is:

1. An electrohydrodynamic pump comprising:

a first electrode having an axis and having a channel formed therethrough along the axis, through which a fluid flows, wherein the channel has an inlet section and an outlet section continuous along the axis from the inlet section, the inlet section being defined by a conical inner surface whose diameter progressively reduces towards the outlet section, and the outlet section being defined by a tubular inner surface;

a tubular dielectric layer applied on the inner surface of the outlet section of the first electrode; and a rod-shaped second electrode coaxially placed in the channel of the first electrode, wherein the second electrode has an insulated first section and a non-insulated second section, the insulated first section being positioned in the inlet section of the first electrode, while the non-insulated second section is positioned such that a part thereof is located in the outlet section of the first electrode and surrounded by the tubular dielectric layer and another part thereof is located in the inlet section of the first electrode and exposed for a predetermined length to the conical inner surface, wherein a DC voltage is applied across the first and second electrodes to generate, between the first and second electrodes, an electric field which acts on dissociated ions in the fluid to pump the fluid from the inlet section to the outlet section.

2. The electrohydrodynamic pump of claim 1, wherein an electrically insulated duct is installed in the outlet section of the first electrode.

3. The electrohydrodynamic pump of claim 1, wherein the predetermined length is set at 5 mm or less.

4. The electrohydrodynamic pump of claim 1, wherein the fluid is 2,3-dihydrodecafluoro-pentane (HFC 43-10).

5. The electrohydrodynamic pump according to claim 1, further comprising at least one third electrode configured to similarly the first electrode and positioned coaxially with the first electrode such that the fluid coming out of the outlet section of the first electrode is received in the inlet section of the at least one third electrode, wherein the first electrode and the at least one third electrode are applied with the same polarity of the DC voltage.

6. The electrohydrodynamic pump according to claim 5, wherein the second electrode has an insulated third section and a non-insulated fourth section, the insulated third section being positioned in the inlet section of the at least one third electrode, while the non-insulated fourth section is positioned such that a part thereof is located in the outlet section of the at least one third electrode and surrounded by a tubular dielectric layer of the at least one third electrode and another part thereof is located in the inlet section of the at least one third electrode and exposed for the predetermined length to the conical inner surface of the at least one third electrode.

7. The electrohydrodynamic pump according to claim 5, wherein the non-insulated second section of the second electrode extends through the outlet section of first electrode in the outlet section of the at least one third section such that a part of the non-insulated second section is located in the outlet section of the at least one third electrode and surrounded by a tubular dielectric layer of the at least one third electrode and another part thereof is located in the inlet section of the at least one third electrode and exposed for the predetermined length to the conical inner surface of the at least one third electrode.

* * * * *